US008178998B2

(12) United States Patent
Dellacona et al.

(10) Patent No.: US 8,178,998 B2
(45) Date of Patent: May 15, 2012

(54) MAGNETICALLY INTEGRATED CURRENT REACTOR

(75) Inventors: Richard Dellacona, Cornona Del Mar, CA (US); Michael James Connor, Tustin, CA (US); Gilbert Amelio, Newport Beach, CA (US)

(73) Assignee: Verde Power Supply, Newport Beach, CA (US)

( * ) Notice: Subject to any disclaimer, the term of this patent is extended or adjusted under 35 U.S.C. 154(b) by 0 days.

(21) Appl. No.: 12/948,419

(22) Filed: Nov. 17, 2010

(65) Prior Publication Data

US 2011/0080055 A1 Apr. 7, 2011

Related U.S. Application Data

(63) Continuation-in-part of application No. 12/495,533, filed on Jun. 30, 2009, now abandoned.

(51) Int. Cl.
*H01F 27/42* (2006.01)

(52) U.S. Cl. ..... 307/104

(58) Field of Classification Search ..... 307/104
See application file for complete search history.

(56) References Cited

U.S. PATENT DOCUMENTS

| | | | |
|---|---|---|---|
| 2,825,869 | A | 3/1958 | Eckert, Jr. et al. |
| 3,168,692 | A | 2/1965 | Lilienstein |
| 3,214,671 | A | 10/1965 | Corey |
| 3,239,743 | A | 3/1966 | Dembowski |
| 3,286,153 | A | 11/1966 | Inose |
| 4,184,128 | A | 1/1980 | Nilssen |
| 4,202,031 | A | 5/1980 | Hesler et al. |
| 4,441,087 | A | 4/1984 | Nilssen |
| 4,507,698 | A | 3/1985 | Nilssen |
| 4,853,611 | A | 8/1989 | Kislovski |
| 4,873,757 | A | 10/1989 | Williams |
| 5,521,573 | A | 5/1996 | Inoh et al. |
| 5,684,678 | A | 11/1997 | Barrett |
| 6,054,914 | A | 4/2000 | Abel et al. |
| 6,175,727 | B1 | 1/2001 | Mostov |
| 6,262,009 | B1 | 7/2001 | Rogers et al. |
| 6,420,953 | B1 * | 7/2002 | Dadafshar ..... 336/200 |
| 7,193,495 | B2 | 3/2007 | Haugs et al. |
| 2009/0115563 | A1 | 5/2009 | Arata et al. |

OTHER PUBLICATIONS

From Wkipedia the online encyclopedia at Internet address: http://en.wikipedia.org/wiki/Magnetic_core#Planar_core.
U.S. Appl. No. 12/495,533, Richard Dellacona.

* cited by examiner

*Primary Examiner* — Robert L. Deberadinis
(74) *Attorney, Agent, or Firm* — Gene Scott; Patent Law & Venture Group

(57) ABSTRACT

A system and method for delivering electrical power-on-demand to at least one load circuit wherein the system operates primarily with reactive power. The method includes inductively coupling power from a source in a primary circuit to one or more load circuits. The system is arranged to store magnetic energy in a core surrounded by planar coils positioned in parallel. The magnetic circuit is toroidal, symmetrical and circuitous. Magnetic energy is transferred between loads through the system. Back currents from the loads are able to be converted to magnetic field energy contributing to the total of stored energy available to the loads. Since the combined energy held in the system is primarily reactive, internal energy losses are small.

19 Claims, 10 Drawing Sheets

MAGNETICALLY INTEGRATED CURRENT REACTOR

CROSS-REFERENCE TO RELATED APPLICATIONS

This is a Continuation-In-Part application filed under 37 CFR 1/53(b) of U.S. patent application Ser. No. 12/495,533, filed Jun. 30, 2009 now abandoned having title of: "Power Supply Using Shared Flux In A Multi-Load Parallel Magnetic Circuit" and has a common inventor to the subject application, and is incorporated herein by reference. The subject application is being filed under 37 CFR 1.102(c)(1) for advancement of prosecution due to applicant's age.

BACKGROUND

The present disclosure relates to the efficient conversion of electrical power signals for delivery of power to one or more loads, for example, converting input voltage and/or current signals to output voltage and/or current signals. Most conventional power supplies use a transformer to convert an input voltage to an output voltage. For example, some conventional transformers include input coils inductively coupled to output coils using a permeable core. In operation, the input coil is energized with an alternating current; this time-varying current, through the input coil, generates an alternating magnetic field in the transformer core, and the time-varying magnetic field induces an alternating current in the output coils.

SUMMARY

In some aspects of the presently described system, AC power is delivered to the system and transferred to a load in accordance with the load's unique power requirement demand. For instance, the system has the ability to deliver an AC current, AC voltage and power to a load.

Implementations may include one or more of the following features. The system also has the ability to deliver a regulated DC current to a load when the system is coupled with a rectifier and regulator circuits. The present system has the ability to transform the voltages and/or current characteristics of a source to the needs of a load. The present system has the ability to function as a reactive energy pool providing power to one, or to multiple loads simultaneously. The value of the loads may be fixed or variable. The present system has the ability to transform power with extremely low loss and exhibits essentially zero loss to ohmic circuit heating. In one aspect of the system, inductive coils are etched into printed circuit boards. These current carriers may be etched in an overlapping arrangement on opposing sides of the boards so that current flow in adjacent top and bottom current carriers is in the same direction resulting in additive generation of flux fields. Symmetrical and coaxial placement of coils and a plurality of centralized permeable cores provides for high coil integration coefficients and lossless energy transfer between primary and secondary coils. Placement of the coils within a permeable magnetically conductive enclosure results in a closed magnetic circuit system that prevents extrinsic flux loss. In one aspect of the system, fabrication may be made using planar deposition and etching techniques. Planar deposition and etching techniques are well-known in the microcircuit field. In one aspect of the system, relatively large insulating plates supporting relatively large diameter conductors forming relatively large radius primary and secondary coils may be constructed to enable handling of large currents. The system may be used in any application where the delivery of voltages and/or currents to loads is required. Typical applications include the delivery of utility power to low voltage AC and DC machines. Other applications include those where utility voltages need to be boosted for higher voltage AC and DC circuits such as for the ionization of gases, molecular beam control circuits and similar devices. Other applications include the stepping up or down of electrical currents to meet the needs of pumps, motors, and similar machines. One important application is the use of the system with regulation and rectification circuits for the charging of batteries, for electric vehicles such as automobiles, trains and trolleys. Another important application is the use of the system in providing current at several fixed voltages simultaneously, through multiple secondary coils, for computer and server operation. Another important application is for the stepping up of power generator voltages for high voltage transmission, and the associated stepping down of such voltages for industrial and residential use. Because the system can accomplish these power transfers with little or no energy loss, the system is able to replace a large number of conventional apparatus in current use.

In some aspects, a system includes a first conductive coil about a central core region and a second conductive coil about the central core region. The second conductive coil is offset from the first conductive coil in a first direction and magnetic-inductively coupled to the first conductive coil. The system includes a first core layer and a second core layer in the central core region. The first core layer is offset from the second core layer in the first direction. The system includes a core insulator layer in the central core region between the first core layer and the second core layer.

Implementations may include one or more of the following features. The first conductive coil includes a first coil layer defining a first conductive spiral about the central core region. The first conductive spiral has a first inner terminus. The first conductive coil includes a second coil layer axially offset from the first coil layer in the first direction. The second coil layer defines a second conductive spiral about the central core region. The second conductive spiral has a second inner terminus coupled to the first inner terminus The system further includes a coil insulator layer between the first coil layer and the second coil layer. The first conductive coil includes a via through the coil insulator layer. The via conductively couples the first inner terminus and the second inner terminus. The second conductive coil includes a third coil layer defining a third conductive spiral about the central core region. The third conductive spiral has a third inner terminus. The second conducive coil includes a fourth coil layer axially offset from the third coil layer. The fourth coil layer defines a fourth conductive spiral about the central core region. The fourth conductive spiral has a fourth inner terminus coupled to the third inner terminus. The third conductive spiral and the fourth conductive spiral each have a first number of turns. The first conductive spiral and the second conductive spiral each having a second, different number of turns. The system further includes a coil insulator layer between the third spiral layer and the fourth spiral layer. The second conductive coil includes a via through the coil insulator layer. The via conductively couples the third inner terminus and the fourth inner terminus. The core insulator layer has a lower magnetic permeability than the first core layer and the second core layer. The core insulator layer includes a first portion in the central core region and a second portion outside the central core region between the first conductive coil and the second conductive coil. The first conductive coil spans a first longitudinal section of the central core region, and the second conductive coil spans a second longitudinal section of the central core region. At least a portion of the first core layer resides in the first longitudinal section, and at least a portion of the second core layer resides in the second longitudinal section. The first conductive coil is a primary conductive coil. The second conductive coil is a secondary conductive coil. The system includes additional primary conductive coils about the central core region in series with the first conductive coil. The system includes additional secondary conductive coils about the central core region and in series with the second conductive coil. Each of the additional secondary conductive coils is inductively coupled to at least one of the additional primary conductive coils. The system includes additional core layers in the central core region. Each of the additional core layers is offset from the other core layers in the first direction. The system further includes additional insulator layers interleaved with the additional core layers. Each of the additional core layers is longitudinally aligned with one of the coils.

In some aspects, a magnetic field is generated in a central core region of an inductive-coupling device by passing an electrical input signal through primary conductive coils about the central core region. The primary conductive coils are spaced-apart from one another in a first direction along the central core region. A portion of the magnetic field is directed through core layers in the central core region. The core layers are spaced apart from one another in the first direction and separated by insulator layers interleaved with the core layers in the central core region. An electrical output signal is generated in secondary conductive coils about the central core region in response to the magnetic field.

Implementations may include one or more of the following features. The electrical input signal includes an input time-varying voltage signal that generates a time-varying magnetic field in the central core region. The electrical output signal includes an output time-varying voltage signal having a different voltage amplitude than the input time-varying voltage signal. The voltage amplitude of the output voltage signal is regulated. The electrical output signal is rectified to generate a time-constant voltage signal. The electrical output signal is provided to a load. The magnetic field includes magnetic flux lines. Directing at least the portion of the magnetic field includes directing a first plurality of the magnetic flux lines through a first one of the core layers and directing a second plurality of the magnetic flux lines through a second one of the core layers. At least a portion of the magnetic field is directed through a magnetic conductor residing at an axial end of the central core region.

In some aspects, a system includes primary coils and secondary coils about a core region. The primary coils and/or the secondary coils define a central axis through the core region. The primary coils are configured to receive an input voltage signal from a voltage source. The secondary coils are configured to generate an output voltage signal in response to the input voltage signal based on inductive coupling between the primary coils and the secondary coils. The system includes core layers and insulator layers in the core region. The core layers are spaced apart from one another along the central axis. Each insulator layer resides between a neighboring pair of core layers.

Implementations may include one or more of the following features. The primary coils and the secondary coils are spaced apart from one another along the direction of central axis. Each of the secondary coils resides between a neighboring pair of the primary coils. Each of the spaced-apart insulator layers including a first portion in the core region and a second portion outside the core region between a primary coil and a secondary coil. The input voltage signal includes an input alternating current signal having an input peak-to-peak voltage amplitude. The output voltage signal includes an output alternating current signal having a different, output peak-to-peak voltage amplitude. The system includes a rectifier circuit coupled to the secondary coils and configured to convert the output alternating current signal to a direct current signal. The input voltage signal includes an input alternating current signal having an input frequency, and the output voltage signal includes an output alternating current signal having the input frequency. The input voltage signal includes an input alternating current signal, and the output voltage signal includes an output alternating current signal having a phase shift with respect to the input voltage signal. The phase shift is less than ninety degrees. The system includes a rectifier coupled to the secondary coils. The rectifier is configured to convert the output alternating current output signal to an output direct current signal. The system includes a voltage regulator coupled to the secondary coils. The voltage regulator is configured to regulate a voltage amplitude of the voltage output signal. The system includes a load coupled to the secondary coils. The load is configured to dissipate the voltage output signal.

In some aspects, a computing system includes a digital processor configured to operate based on an output electrical power signal from a power supply. The power supply includes primary coils about a central core region. The primary coils are spaced apart from each other in a first direction. The primary coils are configured to receive an input electrical power signal. The power supply includes core layers in the central core region. The core layers are spaced apart from each other in the first direction and separated by insulator layers in the central core region. The power supply includes a secondary coils about the central core region. The secondary coils are configured to generate the output electrical power signal based on magnetic inductive coupling with the primary coils.

Implementations may include one or more of the following features. The system includes a voltage source. The voltage source is configured to provide the input electrical power signal to the power supply. The system includes an integrated circuit that includes the digital processor, the power supply, and at least one conductor that electrically couples the power supply with the digital processor. The system includes a printed circuit board. The digital processor is mounted in a first location on the printed circuit board, and the power supply is mounted in a second location on the printed circuit board. The printed circuit board includes at least one conductor that electrically couples the power supply with the digital processor. The system includes a housing about the power supply, and the digital processor residing outside of the housing. The system includes a server. The server including a server housing that houses the digital processor and the power supply. The system includes a personal computer device including the digital processor and the power supply. The system includes an on-board computing system of a vehicle. The on-board computing system includes the digital processor and the power supply.

The details of one or more embodiments of these concepts are set forth in the accompanying drawings and the description below. Other features, objects, and advantages of these concepts will be apparent from the description and drawings, and from the claims.

DESCRIPTION OF DRAWINGS

Like reference symbols in the various figures indicate like elements.

DETAILED DESCRIPTION

Figure 1:
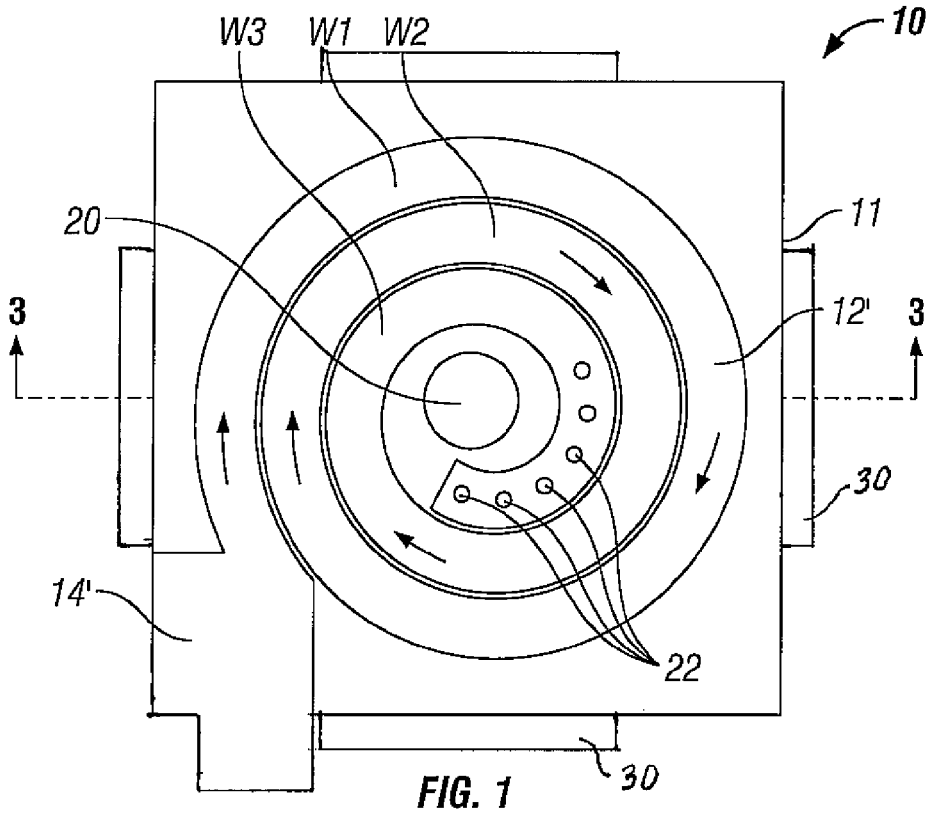
FIG. 1 is a plan view of an example obverse surface of a printed circuit board according to the present description.
Figure 2:
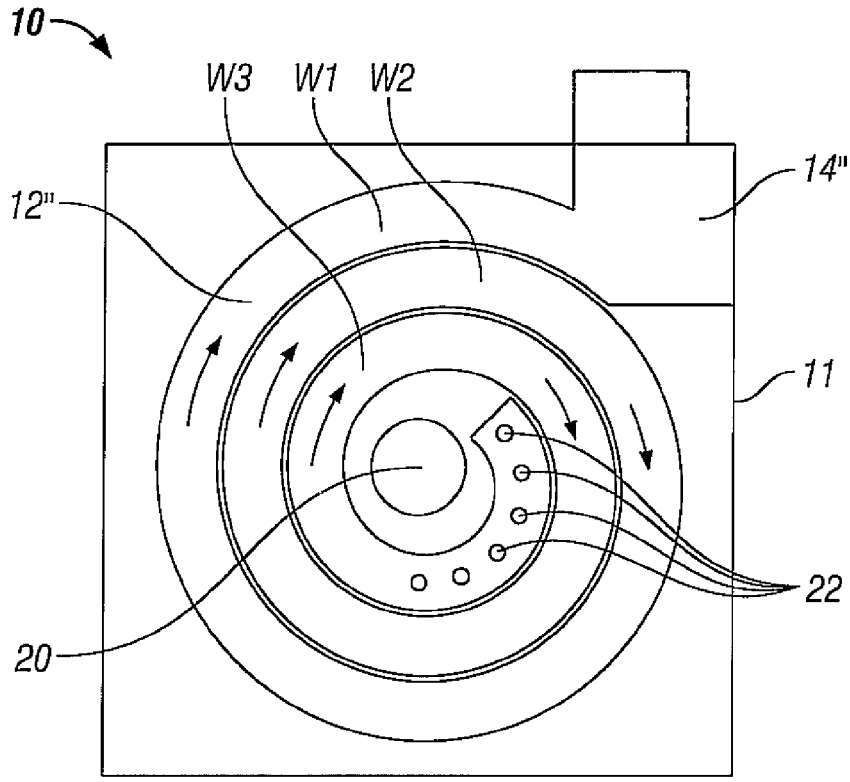
FIG. 2 is a plan view of an example reverse surface of the same printed circuit board shown in FIG. 1 as viewed through the obverse surface.
Figure 3:
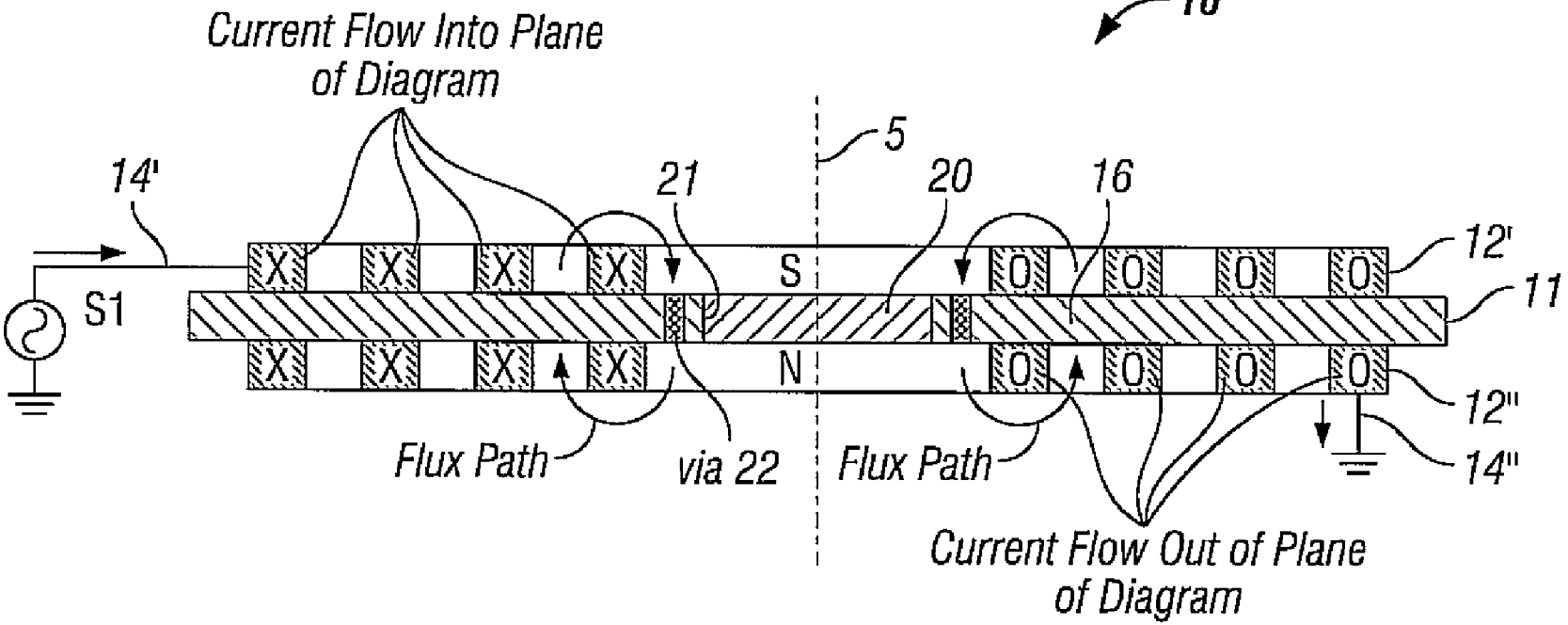
FIG. 3 is an example vertical cross-section view taken along line 3-3 in FIG. 1, as interconnected with an external source.

FIG. 1 is a printed circuit card 10 according to the system of the present disclosure. The card 10 has an insulating planar board 11 which may be 0.06 inches thick, with an etched copper coil portion 12' on a top surface of board 11 and an etched copper coil portion 12" on the bottom surface of board 11 as seen in FIG. 2. FIG. 1 is a plan view as viewed from above the board. FIG. 2 is also as viewed from above as if board 11 were transparent. The etched coil portions 12' and 12" may be in the form of planar spirals as shown, each having plural windings W1, W2, W3 where three windings are shown here for example only and may be fewer or a greater number of windings. The etched coil portions 12' and 12" may be 4 ounce copper, approximately 0.0055 inches in thickness, laminated to board 11, and the coils 12 may be positioned as mutually parallel, adjacently spaced apart, and coaxially aligned about axis 5 as is shown in FIG. 3. Alternatively, other coil thicknesses and materials and mutual positioning may be used and are within the scope of the present disclosure. Each of the windings may be typically between 0.04 and 0.22 inches wide, however other widths may be used. Card 10 may be fabricated using etching printed circuit board techniques. The general techniques for printed circuit board fabrication are well known. As shown at the left in FIG. 1, an input electrode 14' is electrically interconnected to the top coil portion 12' and at the right side in FIG. 2, an output electrode 14" is electrically interconnected to the bottom coil portion 12". The two coil portions 12' and 12" are joined at their inner-most winding by one or more conductive via electrodes 22 which penetrate board 11 and establish electrical continuity between the two coil portions 12' and 12". Via electrodes 22 may be plated through holes in board 11. As shown, the coil portion 12' is wound in a clockwise sense starting at input electrode 14', and moving toward its inner-most winding W3 as shown. Coil portion 12" is also wound in a clockwise as seen viewed from above card 10, but this time moving from its inner-most winding W3, outward toward its outer-most winding W1 and terminating at output electrode 14". Coil portions 12' and 12" may be very close in size, shape and conformation so that when oriented in a mutually concentric arrangement, as shown in FIG. 3, the corresponding windings W1, W2 and W3 of both coil portions 12' and 12" lie in close mutual registration, although not perfect registration since the windings do not prescribe true circles due to their spiral shape. The number of windings of each of coil portions may be the same, different and may have more or less turns. In FIGS. 1 and 2 it is shown that at the present instant in time, current flow direction, indicated by arrows, in both coil portions 12' and 12" is in the clockwise sense as viewed from above card 10 so that magnetic flux generated by the two coil portions are additive. When current reverses, the current direction in both coil portions 12' and 12" also reverses. In FIG. 3 the direction of current flow in the windings (current carriers) is shown by either an "X" indicating that flow is into the plane of the diagram, and by an "O" indicating that flow is out of the plane of the diagram and the sense of current flow is in accordance with that of FIGS. 1 and 2. In FIG. 3, the direction of electrical current entering card 10 from source S1 and that leaving card 10 to ground is illustrated by linear arrows. Magnetic fields are generated around the windings due to current flow and current variations (AC currents) and may be represented by flux, a measure of field strength, whose paths are shown as curved arrows in FIG. 3. It is noted that the flux generated by each set of adjacent windings on the top and on the bottom of board 11 are additive. Faraday's law of induction and Gauss's law of electric fields express the relationships between the magnetic flux, the magnetic field, the electric field and the electromotive force.

At the geometric center of coil portions 12' and 12" a circular permeable core 20 may be secured within a round hole 21 in board 11 as best shown in FIG. 3. The material of core 20 is selected to have a relatively flat permeability characteristic over the range of field strength experienced, which may be from a fraction of a Tesla to about 2 Tesla (Weber per square meter). This allows the apparatus to be applied with predicable results to a wide range of applications. Core materials found to perform well in the present apparatus are "moly-permalloy powder" known as "MPP" as manufactured by Micrometals, Inc. of Anaheim Calif. With the current flow direction as shown, magnetic fields are generated as indicted by the magnetic flux lines shown which encircle the windings, and these fields magnetize the permeable core 20 as shown by the south "S" and north "N" pole indications. When current flow is reversed, the magnetic poles of core 20 also reverse. An AC input current produces a cyclically reversing pole sense at core 20. In this disclosure, the coil portions 12' and 12" on any one printed circuit card 10, are referred to by the term "coil 12." As shown in FIG. 4, using this terminology, each of printed circuit cards 10A, and 10B, have a coil 12.

Figure 4:
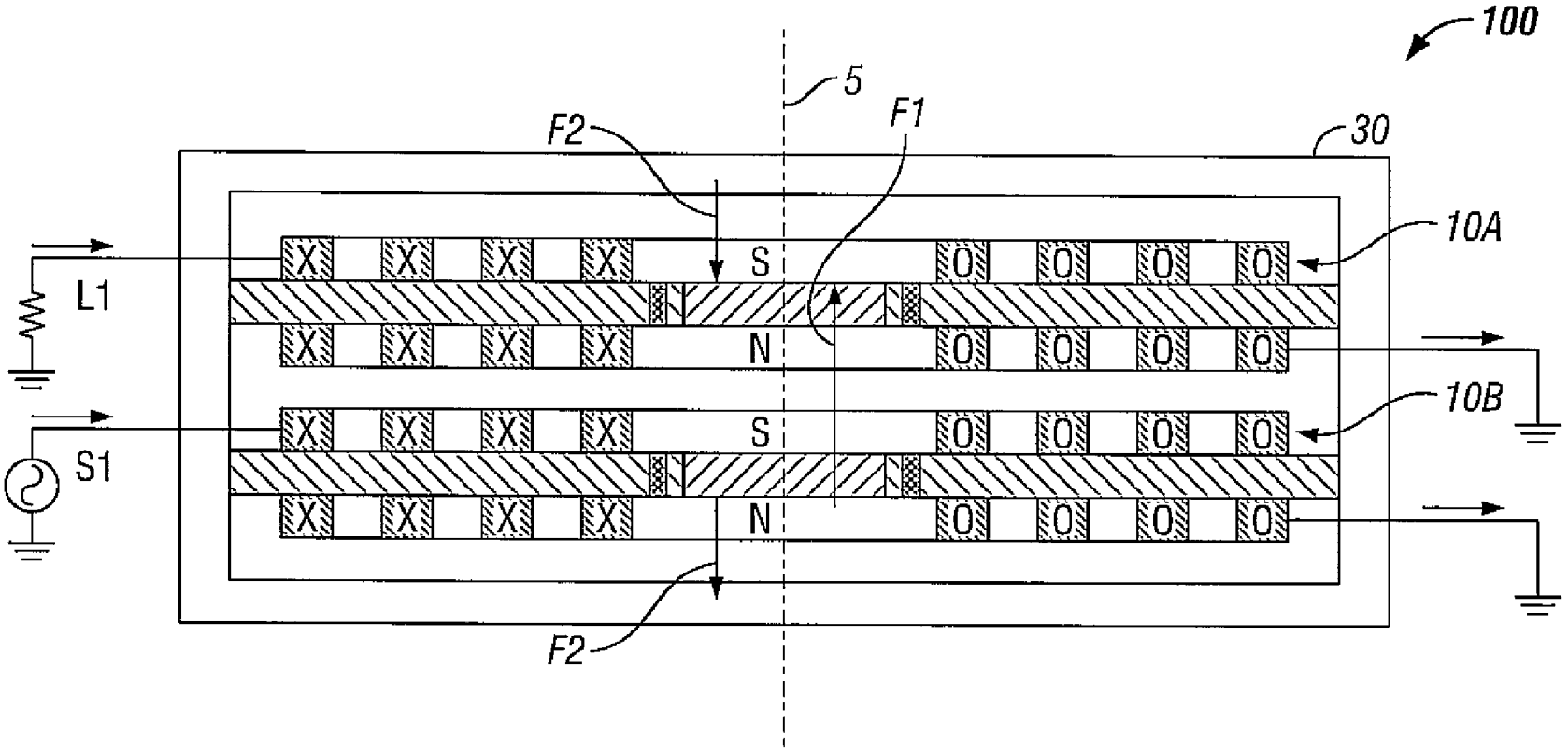
FIG. 4 is a vertical cross-section view of an example system described herein having two of the printed circuit boards as shown in FIG. 1 interconnected with an external source and an external load.

Described now, and shown in FIG. 4, is a system 100 wherein two of the circuit cards 10 described above, and illustrated in FIGS. 1-3, may be mounted within a housing 30 in a mutually spaced apart, mutually concentric arrangement about the central axis of symmetry 5. The spacing between adjacent cores 20 on cards 10 may be about 0.002 inches, The material of housing 30 may be cold-rolled non-grain oriented silicon steel which has a value of magnetic permeability (μ) in the range of $8.75\times10^{-4}$ Henry per meter (H/m).

Figure 6:
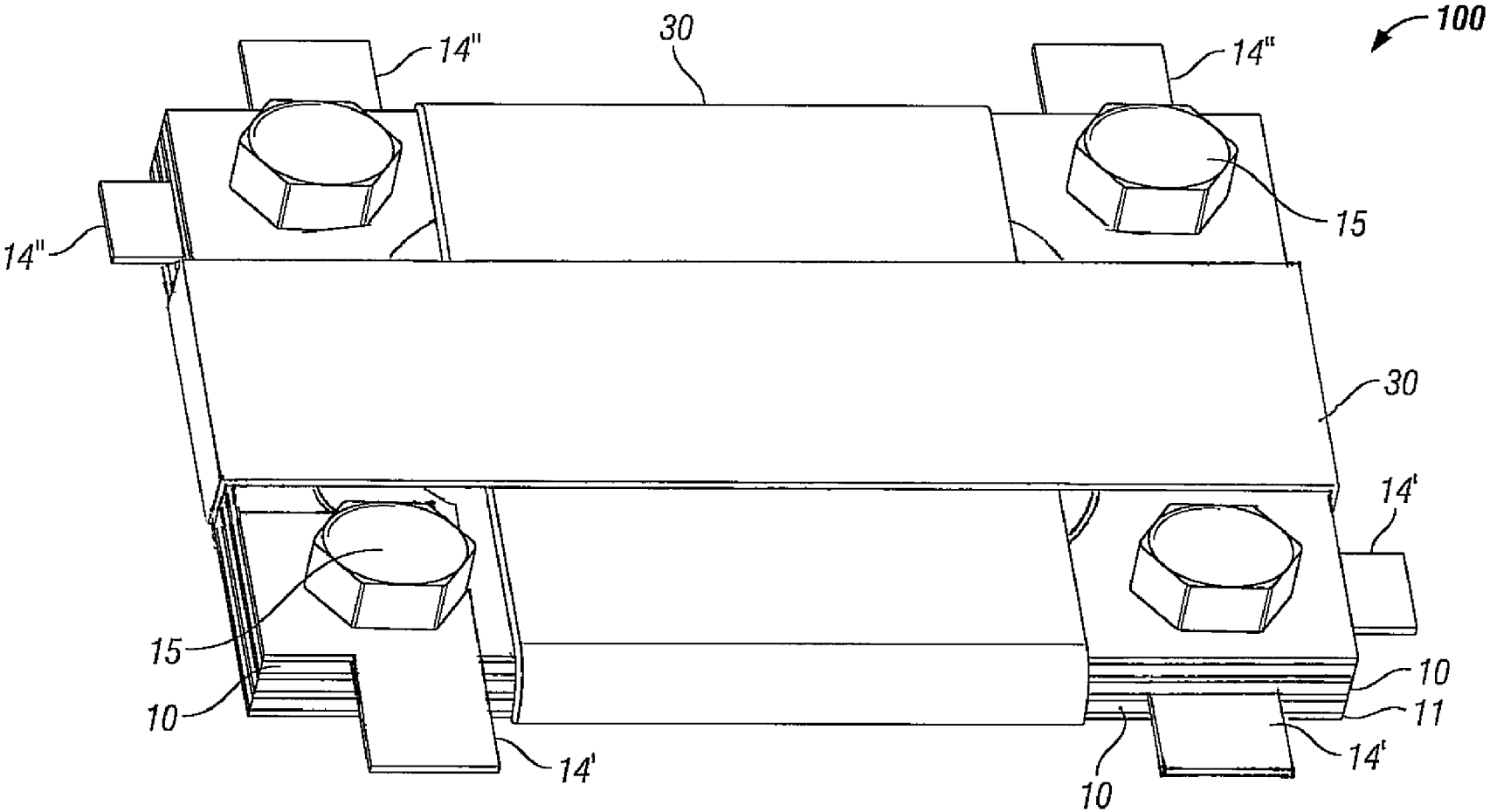
FIG. 6 is a perspective view of the example system of FIG. 5.

The two cards 10 are labeled as 10A in the top position, and 10B in the bottom position in FIG. 4 in this elemental version of the present system 100. These two cards 10 are held rigidly in parallel positions by hardware 15 which is made of electrical non-conducting material such as nylon, as shown in FIG. 6. In operation, card 10B may be interconnected with an AC source S1 as is shown in FIG. 4, with, at the present instant in this diagram, current is flowing into the coil portion 12' (on top of the card 10B) and out of coil portion 12" (on the bottom of the card 10B), as depicted by arrows. As previously described, the direction of current flow shown produces a relative south "S" magnetic pole on the upper surface of core 20 of card 10B and a relative north "N" magnetic pole on the lower surface. The magnetic fields produced by card 10B induces current flow in the coils of the top card 10A when the coil is engaged with load L1 as shown. The magnetic pole orientations are identical for both cards 10A and 10B. The induced currents in card 10A produces magnetic fields adding to the flux produced by card 10B.

Figure 8:
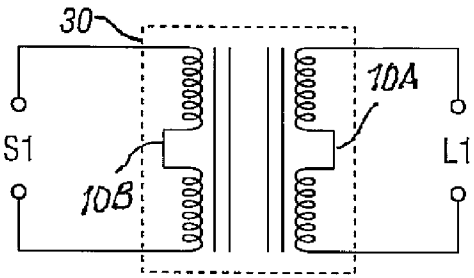
FIG. 8 is an example electrical schematic diagram of the system of FIG. 4 showing a primary circuit and a secondary circuit within a housing.

In FIG. 4, vector F1 represents the net flux from both cards 10A, and 10B as well as any flux generated by currents reflected back to system 100 from load L1 as will be discussed below. Vector F1 is directed along axis 5 because of the induced magnetic poles of permeable cores 20 and the symmetrical arrangement of the coils 12, and with a net direction as shown corresponding to the indicated current direction of flow. The axial net magnetic flux vector F1 extends from the north N pole of card 10B to the south S pole of card 10A in parallel to axis 5. Housing 30 acts as a magnetic flux conduit between the permeable cores 20 of cards 10A and 10B providing a flux path around the periphery of system 100. Therefore, magnetic flux vector F2 is directed through housing 30 from the north N pole of card 10B to the south S pole of card 10A as shown. The magnetic circuit including the permeable cores 20 and the housing 30 stores and moves magnetic energy during system operation as will be described. The magnetic circuit is formed very roughly as a toroidal shaped magnetic flux path with the cores 20 and the spaces adjacent to the cores 20 representing the flux path at the center of the toroid, and the housing 30 representing the exterior flux path of the toroid. The circuit of FIG. 4 is illustrated schematically in FIG. 8.

Figure 5:
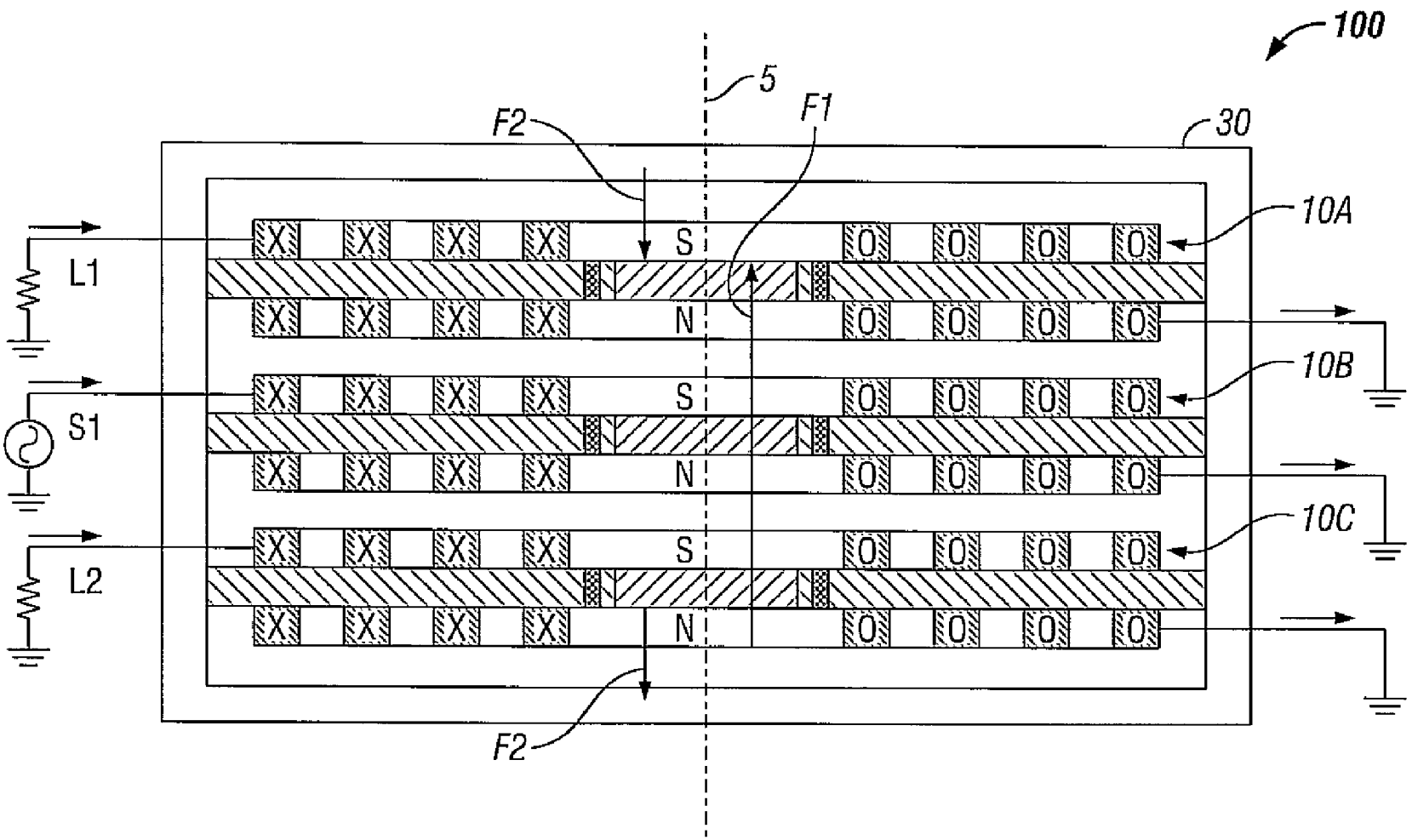
FIG. 5 is a vertical cross-section view of an example system described herein having two of the printed circuit boards as shown in FIG. 1 interconnected with an external source and two external loads.
Figure 9:
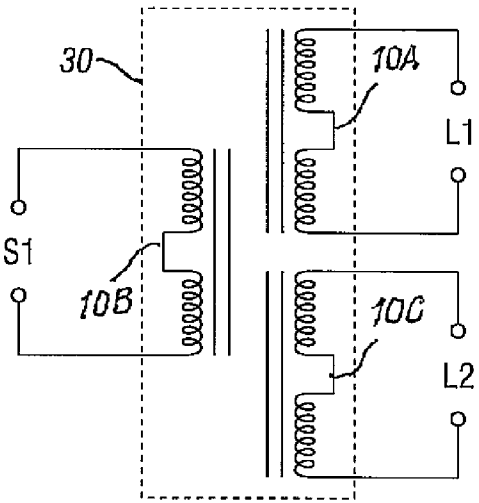
FIG. 9 is an example electrical schematic diagram of the system of FIG. 5 showing a primary circuit and two secondary circuits within a housing.

FIG. 5 is a further embodiment of system 100 shown in FIG. 4 and described above, with the additional card 10C added. This circuit is illustrated in FIG. 9. Here, the primary circuit 10B supports two secondary circuits represented by cards 10A and 10C mounted adjacent to opposite faces of card 10B. It is noted that in FIG. 6 the housing 30 is made up of two metallic sheets, one wrapped in a loop around the cards 10A, 10B and 10C in a first direction, and a second one wrapped about the same cards in a second loop which is positioned transverse to the first. Together these two metallic sheets fully enclose the coils 12. FIG. 5 shows housing 30 in a schematic representation, which may be the same, similar to, or different from the housing 30 shown in FIG. 6. The load circuits L1 and L2 may not be identical and typically these loads may vary with time. Therefore, at any instant current demand at loads L1 and L2 will differ. The reactive components, that is, inductive and capacitive reactances of loads L1 and L2 will differ instantaneously as well. During operation of the system 100 shown in FIG. 5, an electrical current flows through coil 12 of card 10B, as received from source S1, and electrical currents are induced in coils 12 of cards 10A and 10C as induced by the varying magnetic fields generated by card 10B. As previously discussed, during operation, magnetic fields are generated by current flow in windings W1, W2 and W3 of each of the three coils 12. Also, since a voltage difference exists across each of: source S1, load L1 and load L2 electric fields exist between adjacent coil portions 12' and 12" both within and between cards 10. Therefore, a process of energy transfer within system 100 occurs between electrical energy in the form of electrical currents on one hand, and magnetic and electric field energy on the other hand. Additionally, extrinsic energy transfer also occurs between system 100 and its loads L1 and L2. Although, loads L1 and L2 are isolated from system 100 with respect to magnetic and electric fields, these loads are energized by electrical currents flowing from system 100. When the loads are complex, i.e., contain reactive elements, there is a two-way movement of energy between the system 100 and the loads L1 and L2. Depending on the magnitude of reactive energy in the loads, and the rate at which energy fields collapse which is dependent upon their hysteresis characteristics, and the phase relationship between the zero crossing of currents, voltages and electric and magnetic fields within system 100 and loads L1 and L2, energy may move bi-directionally. Energy transferred to system 100 in the form of electrical currents from loads L1 or L2 is immediately converted to magnetic flux through coils 12 and adds to the flux F1 already present. Since flux F1 is available to both coils 12 in the load circuits (cards 10A and 10C) it should be understood that some of the energy ultimately delivered to one of the loads L1 or L2 may be reflected energy from the other of the loads. Since cards 10A and 10C have similar physical and electrical properties there may be no appreciable bias with respect to energy transfer to one of the cards versus the other of the cards.

In an alternative embodiment, the example system 100 shown in FIG. 5 (and/or one or more of the other example systems shown and described herein) may be modified to include one or more control coils. A control coil may be implemented as a planar conductive spiral coil positioned between one or more pairs of current-carrying coils (e.g., primary and secondary coils) and/or other locations in the system 100. In some examples, a control coil may made of copper or another conductive material on a printed circuit board. The one or more control coils may be electrically coupled (e.g., in parallel, in series, etc.) and/or inductively coupled to one or more of the current-carrying coils in the example system 100.

Figure 7:
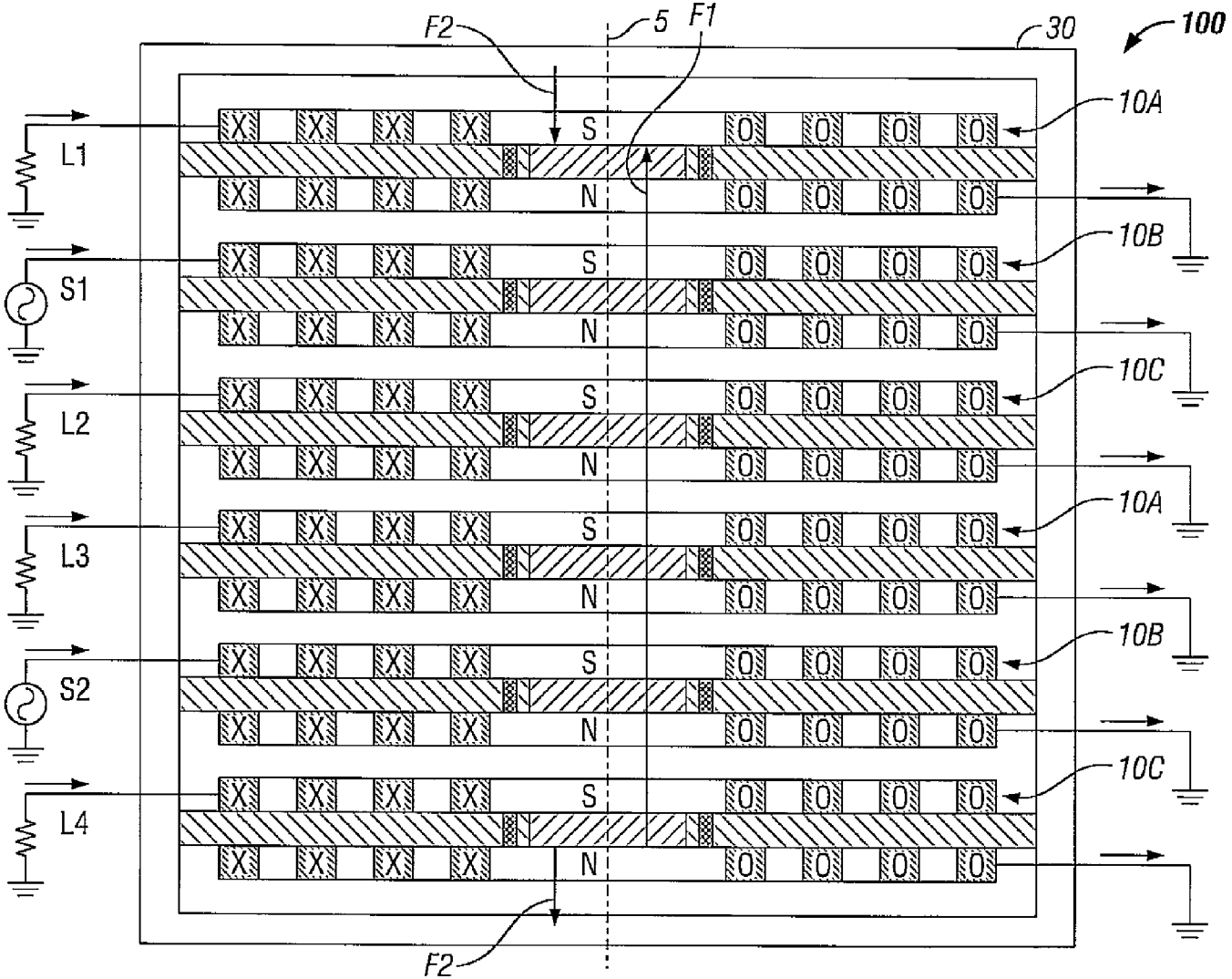
FIG. 7 is a vertical cross-section view of an example system described herein having six of the printed circuit boards as shown in FIG. 1 interconnected with two external sources and four external loads.
Figure 11:
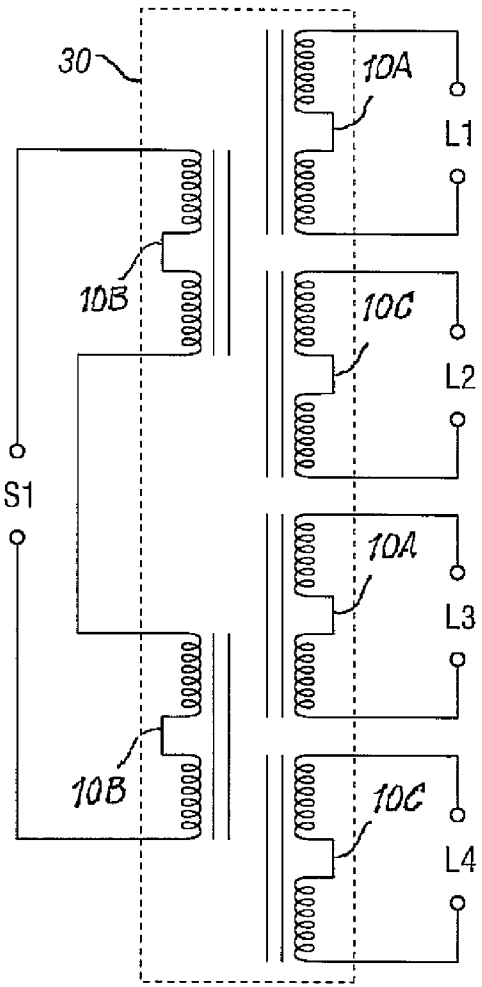
FIG. 11 is an example electrical schematic diagram of the system of FIG. 7 wherein the two primary circuits are arranged in electrical series interconnection.
Figure 10:
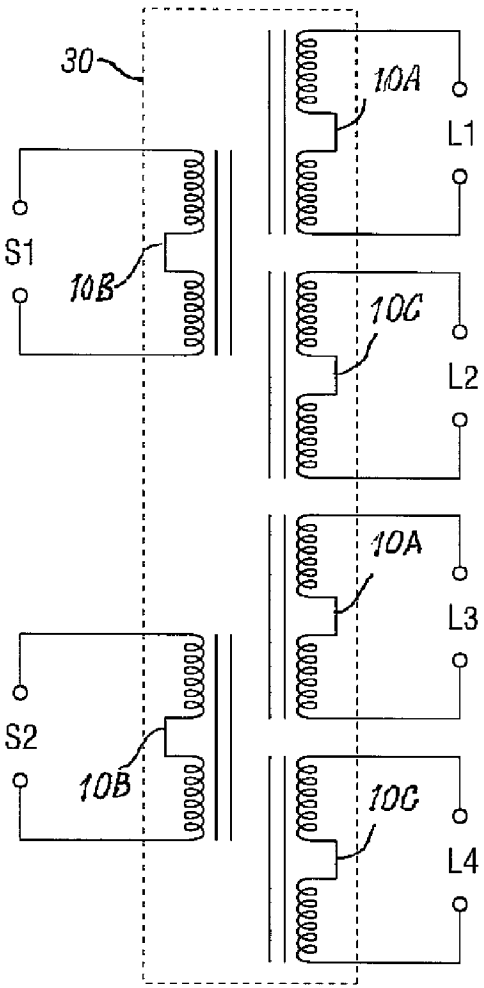
FIG. 10 is an example electrical schematic diagram of the system of FIG. 7 showing two primary circuits and four secondary circuits within a housing.
Figure 12:
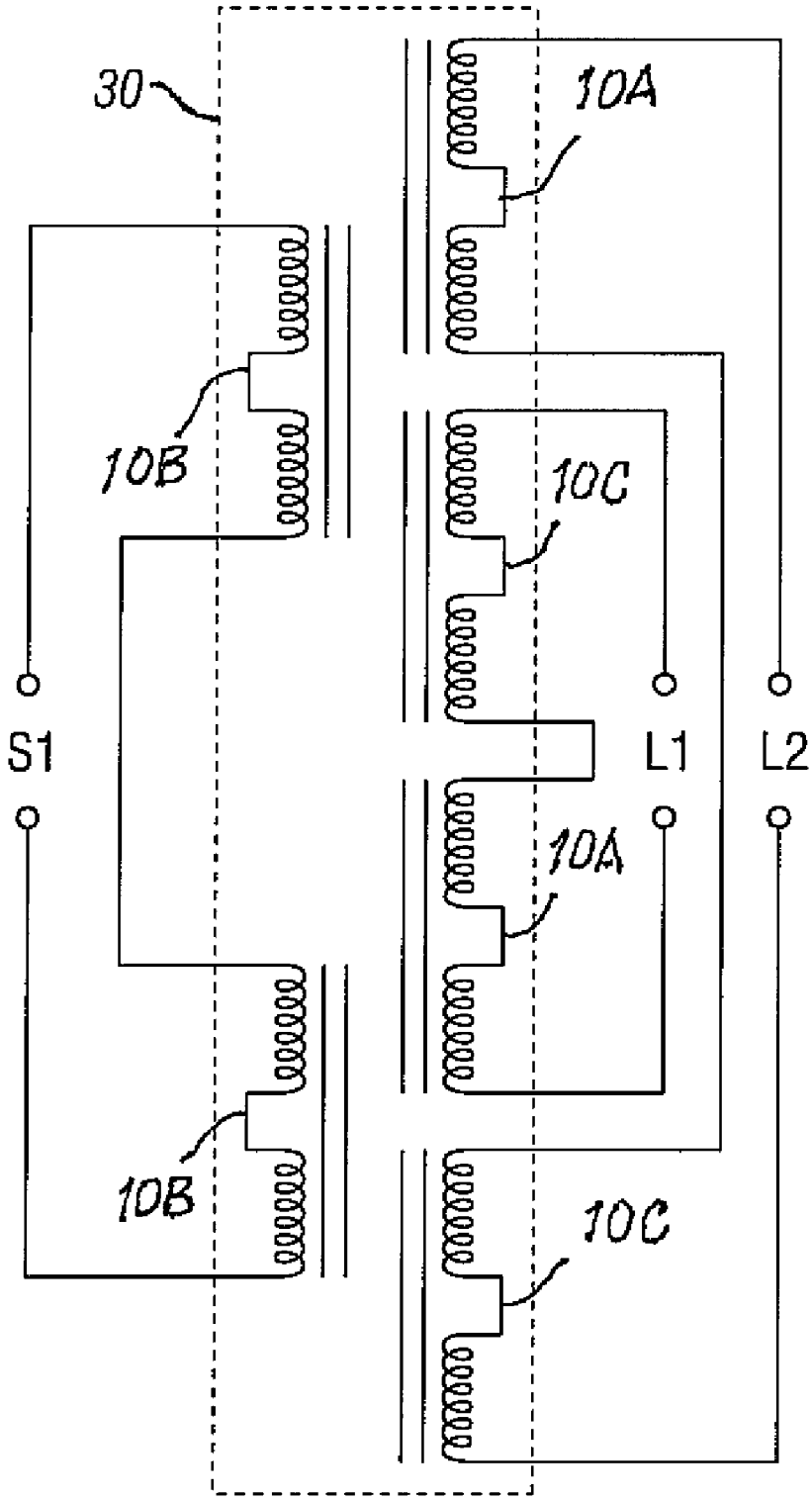
FIG. 12 is an example electrical schematic diagram of the system of FIG. 7 wherein the two primary circuits are in electrical series interconnection and two pairs of the secondary circuits are each interconnected in series electrical interconnection.

FIG. 7 shows that more elaborate arrangement which comprises two sets of cards 10 within a single housing 30. This is illustrated schematically in FIG. 10. Here, two separate sources S1 and S2 each drive two loads circuits: L1 and L2; and L3 and L4 respectively. Any number of sources may be contained within a single housing 30 in the manner shown in FIG. 7. The arrangements shown in FIGS. 4 and 5 may be used as building blocks for assembling any combination of primary and secondary structures in the manner shown in FIGS. 4, 5 and 7 and energized in any manner whatsoever. For instance the assembly shown in FIG. 5 may be energized as shown in the schematic diagrams of FIG. 10, 11, or 12 as just a few examples and it should be realized that many more configurations are possible.

In system 100, the instantaneous total magnetic energy available to the secondary circuits derives from the primary circuit(s), residual energy stored in the cores 20 and housing 30, and within the spaces between the cores 20, and finally magnetic energy reflected back to the system 100 from its loads. The system is capable of storing this energy and delivering it to its loads on demand. This results in limiting the amount of power drawn from its source(s). Also, because most of the energy stored in system 100 at any instant is held in a reactive state, the amount of energy lost to heat within system 100 is quite small. This is partially due to the limitation on input power due to magnetic energy sharing as described above, and partially due to the physical conformation of the conductors of coils 12, i.e., relatively short current flow paths and maximum cross-sectional area.

Figure 13:
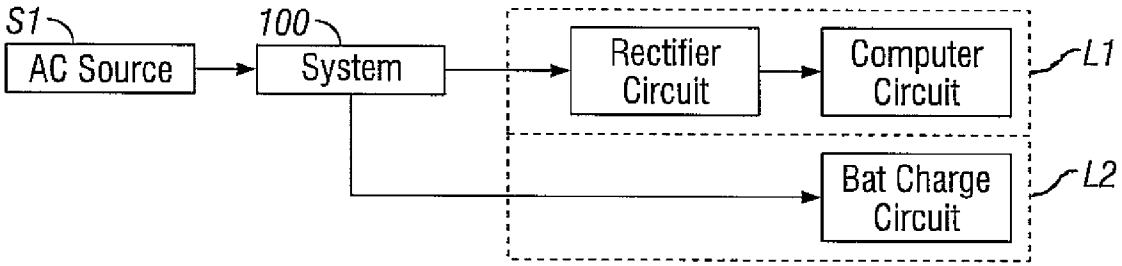
FIG. 13 is a block diagram representing an example of the system of FIG. 5 in an application for providing power to circuits of electronic devices.

The cards 10 described above may be manufactured using printed circuit board fabrication techniques. This approach has the advantage of being able to make the coils of the three cards close copies of each other. The system 100 manufactured in this manner can be expected to handle currents in the range of a small fraction of an ampere up to several tens of amperes. Applications for such a system 100 include computer circuits and charger circuits as shown in FIG. 13.

Figure 14:
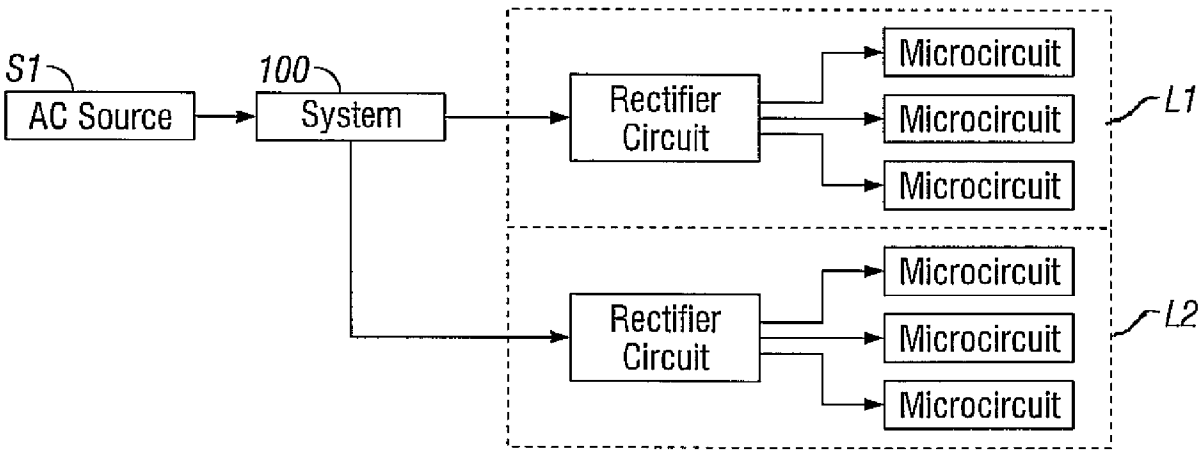
FIG. 14 is a block diagram representing an example of the system of FIG. 5 in an application for providing power to microcircuit devices.
Figure 15:
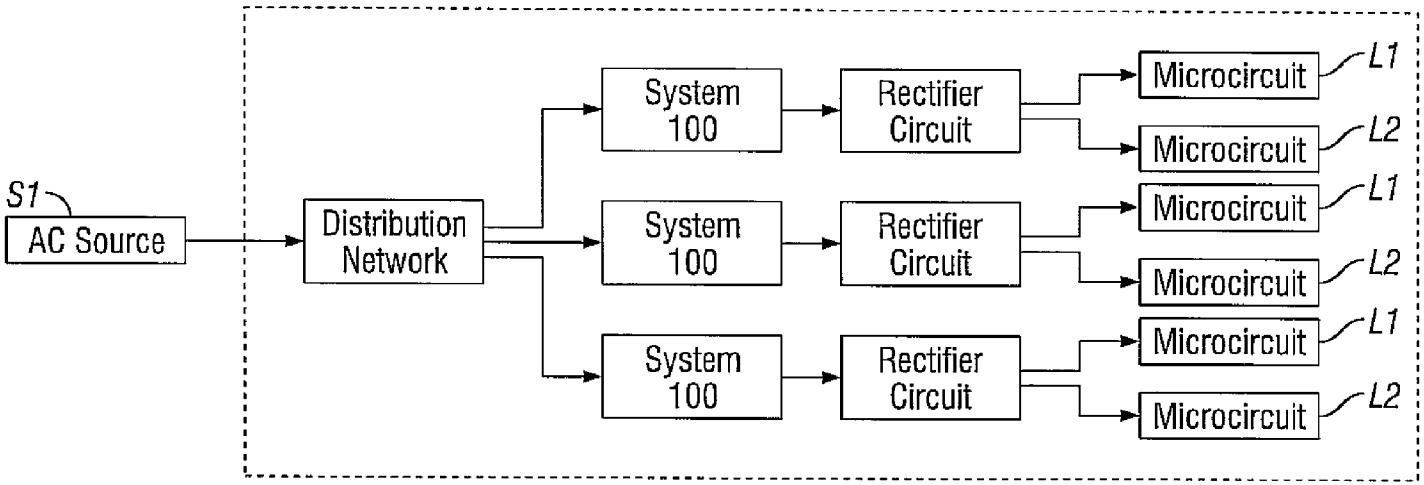
FIG. 15 is a block diagram representing a further example of three of the system of FIG. 5 in an application for providing distributive power to plural solid state microcircuits.

System 100 may also be fabricated using microcircuit planar fabrication techniques capable of producing a large number of nearly identical devices simultaneously. The general processes for manufacturing microcircuits by deposition and etching techniques are well known. Referring to FIGS. 4, 5 and 7, the layers shown may be fabricated on a much smaller scale as thin films deposited by chemical or physical deposition techniques. Such layers may be of magnetically permeable materials, electrical insulators and electrical conductors. Spaces between conductor layers may be formed by depositing insulating materials such as SiO2, and conductors may be Au or Cu layers etched to a pattern using dry or wet chemical etching processes. Using this approach, coils 12 are able to be fabricated with very close physical and electrical tolerances. Such micro-sized versions of system 100 may be applied to a broad range of electronic circuits as shown in FIGS. 13 and 14, and also in a distributive power delivery application where system 100 is sealed within a microchip package along with micro-chip loads, i.e., circuits such as shown in FIG. 15.

Figure 16:
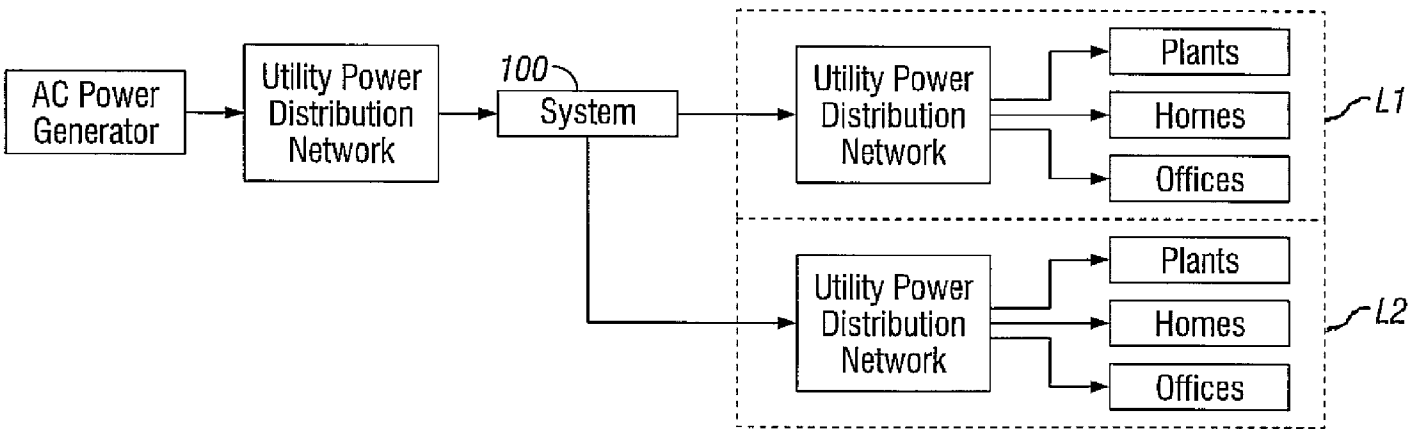
FIG. 16 is a block diagram representing an example of the system of FIG. 5 in an application for providing power integral to utility power distribution networks.

FIG. 16 shows an application where system 100, may be applied in a utility power situations, as for instance in voltage step-up or step-down functions as exemplified by FIG. 16. For step-up and step-down functions, the ratio of primary to secondary coil turns is applied as in standard transformers.

The method of operation of the above described system 100 results in delivering electrical power on demand with low loss to a load L1 as in FIG. 4, or to dual independent loads as shown in FIG. 5, or to plural pairs of such loads as shown in FIG. 7. An exemplary method inductively couples a first input electrical energy, the input electrical current from source S1 in FIG. 4 for instance, within a primary planar electromagnetic energy converter, printed circuit card 10B, for example, to a pair of secondary planar electromagnetic energy converters such as cards 10A and 10C for example. Output electrical energy from the secondary planar electromagnetic energy converters is therefore delivered, as shown in FIG. 5, to the pair of independent loads L1 and L2. In this method, electromagnetic energy is stored within a toroidal-shaped magnetic circuit. The toroidal shape comprises the axial core which supports magnetic flux represented by vector F1 as shown in FIGS. 4, 5, and 7 for example, and the peripheral permeable enclosure 30. This magnetic circuit is common to both the primary 10B and to secondary 10A and 10C planar electromagnetic energy converters. We refer to the cards as "converters" stressing their function rather than their physical attributes. Portions of the stored electromagnetic energy is delivered, as output electrical energy, in the form of electrical current, to each of the independent loads L1 and L2 as independently demanded by each of these loads. These currents are able to provide some or, at times, all of each load's needs, thereby reducing the amount of energy that is drawn from the source S1. The stored electromagnetic energy of the magnetic circuit is held primarily within the axial core as represented by flux vector F1 and which is centered on axis 5. It should be realized that energy stored in the toroidal magnetic circuit is highly transient, moving into and out of the axial portion in nanoseconds. This magnetic energy is primarily directed to and stored in the linear, mutually parallel and spaced apart arrangement of the permeable cores 20 and also within the spaces between the cores 20. The spaces enable magnetic energy storage without being limited by magnetic saturation effects.

When the loads L1 and L2 operate on alternating currents and have reactive components, e.g., inductors and capacitors, the cycles of their stored energy fields are typically not in phase with the input current provided by source S1, so that magnetic and electric fields of these reactive components may release energy into the system 100 as back flowing transient currents. This energy may be stored as magnetic flux contributions to F1 and/or F2. The flux represented by F1 is axially aligned with the primary and secondary planar electromagnetic energy converters 10A, 10B, and NC along axis 5 in FIG. 5. In summary, system 100 is a reactor converting electric currents to magnetic fields and back to electric currents to drive one or more loads from a shared magnetic energy pool so that each of the loads is able to draw energy as needed (on demand) and wherein a very small amount of energy is converted to heat due to the fact that system 100 operates primarily with the reactive component of electrical power.

A number of embodiments have been described. Nevertheless, it will be understood that various modifications may be made without departing from the spirit and scope of this disclosure. Accordingly, other embodiments are within the scope of the following claims.

What is claimed is:

1. A low loss power delivery system comprising:

mutually parallel, adjacently positioned, and coaxially aligned planar elements including:

a first planar electrically conductive coil interconnected with an electrical source;

a second planar electrically conductive coil interconnected with a load;

the first planar coil having a centrally positioned, magnetically permable co-planar core;

the second planar coil having a centrally positioned, magnetically permeable co-planar core spaced apart from the co-planar core of the first planar coil;

the coils supported within a magnetic flux conduit, the cores and flux conduit enabled as a toroidal flux circuit.

2. A low loss power deliver system comprising;

mutually parallel, adjacently positioned, and coaxially aligned planar elements including:

a first electrically conductive coil interconnected with an electrical source;

a pair of second electrically conductive coils, each one of the second coils interconnected with a separate load;

the first and second coils each having a centrally positioned, magnetically permeable core;

the first coil spaced between the pair of second coils;

the first and second coils supported within a magnetic flux conduit, the cores and flux conduit enabled as a toroidal flux circuit.

3. The system of claim 2 wherein, each of the coils comprises two concentrically aligned adjacent coil portions in mutual electrical series interconnection.

4. The system of claim 3 wherein, the two coil portions are wound to generate mutually additive magnetic flux when carrying an electric current.

5. The system of claim 2 wherein the permeable cores of the first and second coils are axially spaced apart.

6. A low loss power delivery system comprising:

a planar primary electrical coil having an electrical insulator sandwiched between two planar, mutually parallel, coaxially and adjacently aligned, electrically conductive, serially connected coil portions, the coil portions wound so that winding turns of the two coil portions are adjacently positioned and additive magnetic flux is generated when an electrical current flows through the two coil portions; and a means for delivering power from the primary electrical coil to a load.

7. The system of claim 6 wherein the primary electrical coil is formed by a subtractive fabrication process.

8. The system claim 6 wherein the means for delivering power comprises a pair of secondary electrical coils coaxially aligned with, and each equally spaced from, the primary electrical coil, each of the primary and secondary coils having a centrally positioned mutually spaced apart magnetically permeable core, the coils enclosed within and supported by a flux conduit whereby the permeable cores and the flux conduit provides a toroidal flux path.

9. A low is power delivery system comprising:

a closed magnetic circuit having a coaxial arrangement of core layers spaced apart by insulator layers, the core layers being mutually parallel, magnetically permable, and positioned within a flux conduit forming a toroidal flax path.

10. The system of claim 9 further comprising a primary electrical coil assembly positioned between and spaced apart from a pair of secondary electrical coil assemblies, wherein each of the electrical coil assemblies is co-planar with one of the core layers the coil assemblies wound so that an axially oriented additive magnetic field is generated when an electrical current flows through the coil assemblies, the axially aligned cores and the flux conduit arranged as a toroidal magnetic path.

11. A method for delivering, electrical power-on-demand with low loss to a pair of independent loads, comprising:

inductively coupling a first input electrical energy in a primary planar electromagnetic energy converter, to a pair of secondary planar electromagnetic energy converters;

delivering a first output electrical energy from one of the secondary planar electromagnetic energy converters to one of the pair of independent loads and a second output electrical energy from another of the secondary planar electromagnetic energy converters, to another of the independent loads;

storing electromagnetic energy within a toroidal magnetic circuit common to both the primary and the seconday planar electromagnetic energy converters;

delivering portions of the stored electromagnetic energy, as a third output electrical energy, to each of the independent loads as independently demanded by said loads.

12. The method of claim 11 further comprising storing the electromagnetic energy primarily within a central axial portion of the toroidal magnetic circuit.

13. The method of claim 12 further comprising storing the electromagnetic energy within and between spaced apart permeable cores.

14. The method of claim 11 further comprising delivering electrical energy from the independent loads to the toroidal magnetic circuit.

15. The method of claim 11 further comprising producing a linear magnetic flux field axially aligned with the primary and secondary planar electromagnetic energy converters.

16. A method for delivering elecltrical power on demand with low loss to independent loads, comprising:

inductively coupling input elecltrical energy to planar electromagnetic energy converters;

delivering output electrical energy from the energy conveners to the independent loads;

storing electromagnetic energy within a toroidal magnetic circuit common to the energy converters; and delivering portions of the stored electromagnetic energy, as independently demanded, to the independent loads.

17. The method of claim 16 further comprising storing the electromagnetic energy within a central axial portion of the toroidal magnetic circuit and establishing a magnetic flux field within the central axial portion of the toroidal magnetic circuit using permeable cores in a linear, mutually parallel and spaced apart arrangement of the permeable cores.

18. The method of claim 16 further comprising delivering electrical energy to the secondary electromagnetic energy converters, the independent loads.

19. The method of claim 16 further comprising producing a linear magnetic flux field axially aligned with the planar electromagnetic energy converters.

* * * * *